United States Patent [19]

Lyman

[11] Patent Number: 4,597,130

[45] Date of Patent: Jul. 1, 1986

[54] ELECTRICAL CONNECTION MEANS FOR CANISTER VACUUM CLEANER

[75] Inventor: John B. Lyman, Bloomington, Minn.

[73] Assignee: Whirlpool Corporation, Benton Harbor, Mich.

[21] Appl. No.: 690,304

[22] Filed: Jan. 9, 1985

[51] Int. Cl.[4] ..... A47L 9/28

[52] U.S. Cl. ..... 15/327 R; 15/339; 15/377; 174/47; 285/7

[58] Field of Search ..... 15/339, 377, 327 R, 15/327 E; 174/47; 285/7

[56] References Cited

U.S. PATENT DOCUMENTS

| | | | |
|---|---|---|---|
| 3,258,553 | 6/1966 | Breslin | 174/47 X |
| 3,277,512 | 10/1966 | Waters | 15/339 |
| 3,375,541 | 4/1968 | Fromknecht | 285/7 X |
| 3,381,652 | 5/1968 | Schaefer et al. | 15/339 X |

*Primary Examiner*—Chris K. Moore

*Attorney, Agent, or Firm*—Wood, Dalton, Phillips Mason & Rowe

[57] ABSTRACT

A canister vacuum cleaner having electrical conductors extending from electrical circuitry in the canister through the connection of the suction hose thereto through electrical conductors embodied in the suction hose to electrical apparatus associated with a nozzle, such as a brush motor therein. The electrical connection between the hose end and the canister is provided by a first electrical connector mounted to the hose end, and a second electrical connector mounted to the base portion of the canister housing. Both the hose suction connector and the first electrical connector at the hose end are freely installable through a suction inlet passage formed in the cover and are then connected to a source of suction and a second electrical connector mounted in the base. Forces developed in connecting and disconnecting the first electrical connector from the second electrical connector are accommodated by the base portion of the canister housing by virtue of the mounting of the second electrical connector thereto in alignment with the suction inlet opening, whereby automatic connection of the electrical connectors is effected as an incident of the installation of the suction hose connector in the suction inlet opening and there is no need for electrical circuitry in the cover. The cover is relatively lightweight and inexpensive as a result of the improved arrangement and is easily removable since there is no need to break an electrical connection.

20 Claims, 7 Drawing Figures

FIG. 1
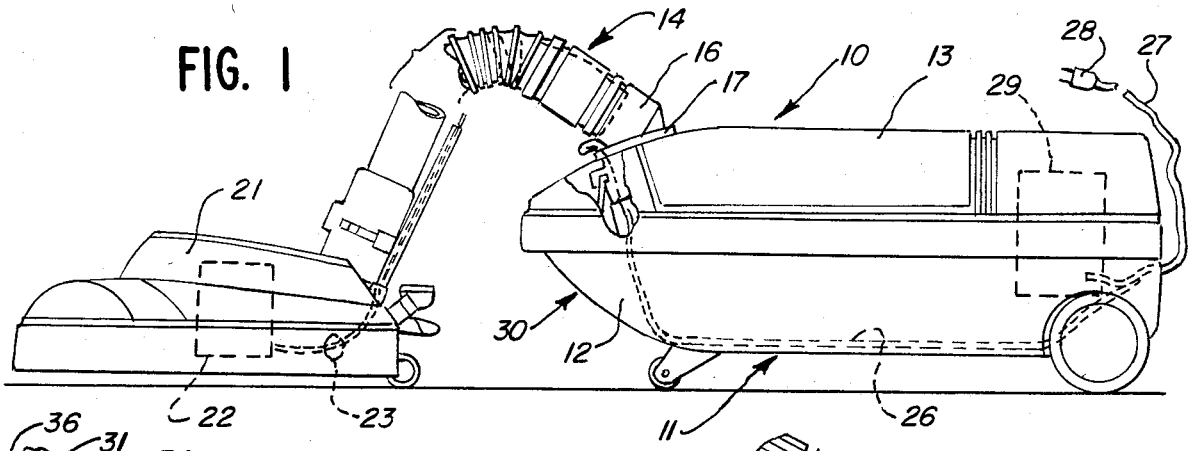
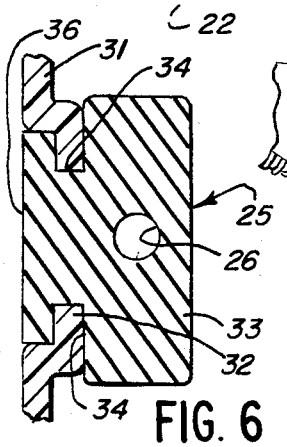
FIG. 6
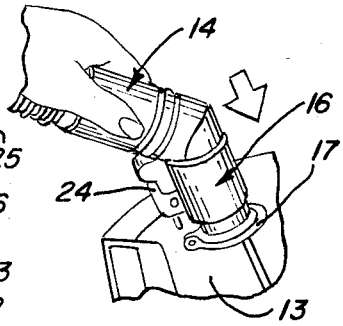
FIG. 2
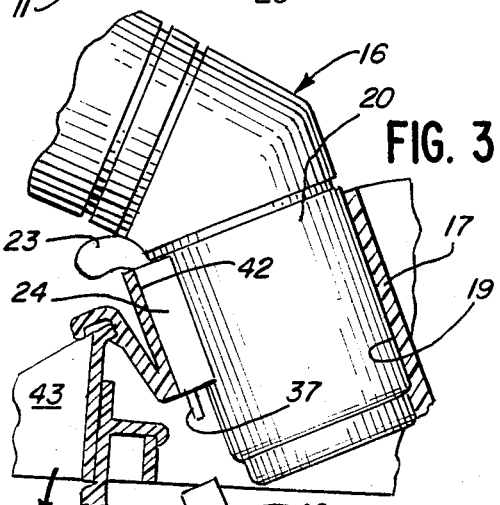
FIG. 3
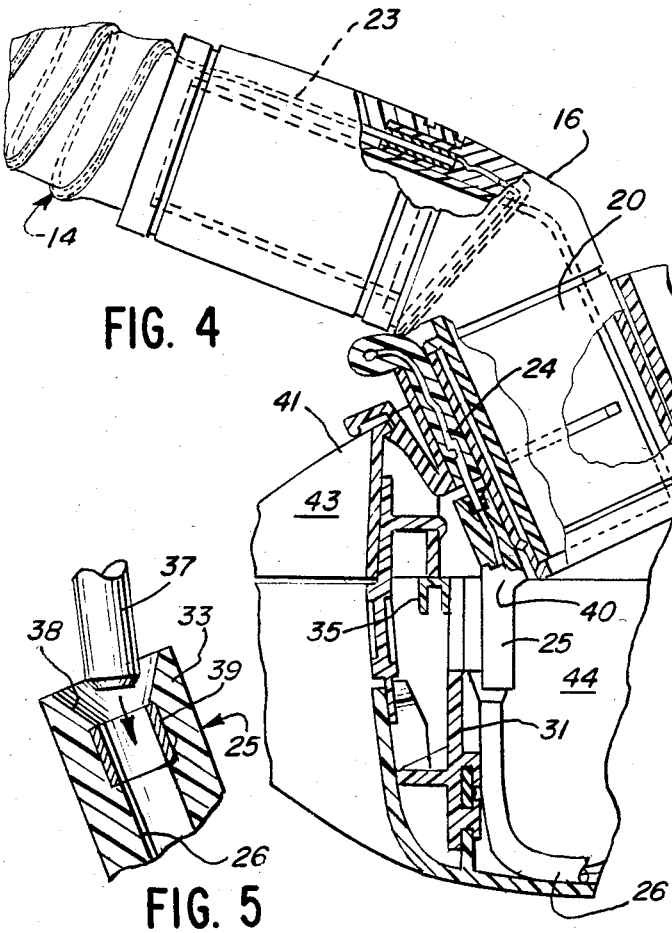
FIG. 4
FIG. 5
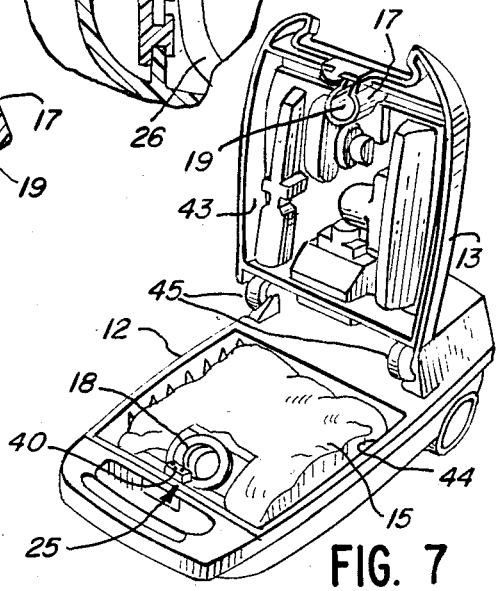
FIG. 7

ELECTRICAL CONNECTION MEANS FOR CANISTER VACUUM CLEANER

BACKGROUND OF THE INVENTION

1. Field of the Invention

This invention relates to vacuum cleaners and in particular to canister-type vacuum cleaners wherein a suction hose is removably connected to the canister and electrical power is provided from the canister to electric means associated with the hose.

2. Description of the Background Art

In the conventional canister-type vacuum cleaner, a suction hose is provided having an end defining a cuff arranged to be removably connected to an inlet opening portion of the canister. Suction means are provided within the canister for drawing the air through the hose and inlet opening into a dirtcollecting bag removably mounted in a suction space within the canister housing.

In one conventional canister housing, the suction space is defined by the base and is selectively closed by a cover. The suction inlet is provided in the cover and the cover includes electrical terminals and circuitry to connect electrical conductors in the suction hose to a source and is adapted to accept the forces involved in connecting and disconnecting the hose end cuff thereto without damaging the cover.

In such canister vacuum cleaners requiring electrical connection between the canister and the hose, a first electrical connector is mounted to the hose end and a second electrical connector is mounted to the canister. It is conventional to mount the second electrical connector to the cover so as to have electrical connection with the first electrical connector concurrently with the suction hose end cuff being connected to the inlet opening means of the cover. Thus, it has been conventional to provide a relatively rigid cover structure to accommodate the substantial forces normally required in effecting the electrical connection and disconnection in the use of the vacuum cleaner, in addition to the smaller forces involved in effecting the suction connection of the hose end cuff to the inlet opening. Further, in such conventional arrangements electrical current at line voltage is necessarily available in the cover and there is a potential safety hazard requiring protection for the operator from contact with current carrying parts in the cover. Additionally, if the cover is removable an electrical disconnect is required. Underwriters' Laboratories, Inc. and the Canadian Standards Association have safety requirements for listing of appliances including such structures. Resultingly, the cover has heretofore comprised a relatively expensive element.

SUMMARY OF THE INVENTION

The present invention comprehends an improved canister-type vacuum cleaner wherein means are provided for avoiding the need for accommodation by the cover of electrical circuitry and connectors and the electrical connection and disconnection forces in such a canister vacuum cleaner. The present invention comprehends the provision of such means which are extremely simple and economical of construction.

More specifically, the invention comprehends the provision of a canister vacuum cleaner structure wherein the electrical connector associated with the canister housing is mounted to the base portion whereby the electrical connection and disconnection forces are accommodated by the base portion and hose end substantially free of the cover. Thus, the cover may be made relatively thin and lightweight and easily removable with no electrical circuitry therein, substantially reducing the cost thereof, while yet providing an improved electrical connector arrangement in the vacuum cleaner.

The suction inlet opening defined by the cover is arranged to substantially freely receive the suction connection end of the hose so that only minimum forces need be accommodated by the cover in the hose end connection and disconnection operations and yet the suction space is sealed tight enough so that it does not leak.

More specifically, the invention comprehends the provision in a vacuum cleaner having a canister including a base defining a suction space and a cover removably closing the space of a suction hose having an end defining a suction connector, means on the cover defining a suction inlet opening for receiving the hose end connector to conduct dirt laden air to the space, and electrical conductor means carried by the suction hose and having a first electrical connector for connection to the suction canister, a second electrical connector complementary to the first electrical connector mounted to the base to have electrical connected association with the first electrical connector as an incident of the suction connector being installed in the inlet opening of the canister, the cover being substantially free of forces developed in effecting electrical connection and disconnection of the first electrical connector relative to the second electrical connector. In the illustrated embodiment each of the first and second connectors has two or more electrical terminals. Two and three wire hose systems are conventional in this art.

In the illustrated embodiment, the second electrical connector is disposed substantially at the inlet opening when the cover is closing the suction space.

The inlet opening defines a passage for passing a first set of electrical connectors to and from electrical connection with a second set of electrical connectors.

In the illustrated embodiment, the cover is hingedly and removably mounted to the base.

As shown, the inlet opening means comprises tubular means slidably receiving the hose suction connector.

Means are provided for guiding the first electrical connector into electrical connected association with the second electrical connector mounted on the base. In the illustrated embodiment, the guiding means are formed integrally with the second set of electrical connectors.

In the illustrated embodiment, the first electrical connector is formed integrally with the suction connector of the hose end.

In the illustrated embodiment, the second set of electrical connectors projects upwardly from the base into a recess defined by the cover when the cover is closing the suction space.

The base defines an upstanding support means, with the second electrical connector being removably secured thereto.

The second electrical connector extends angularly upwardly from the base in the illustrated embodiment to extend substantially perpendicularly toward an inclined wall portion of the cover.

In the illustrated embodiment, the second electrical connector is resiliently yieldably secured to the base support.

The improved canister vacuum cleaner structure of the present invention is simple and economical of construction, while yet avoiding the need for current carrying electrical components in the cover providing positive accommodation of the forces developed in connecting and disconnecting the electrical connection means thereof without need for accommodation of any such forces in the cover.

BRIEF DESCRIPTION OF THE DRAWING

Other features and advantages of the invention will be apparent from the following description taken in connection with the accompanying drawing wherein:

FIG. 1 is a fragmentary side elevation of a canister vacuum cleaner embodying the invention;

FIG. 2 is a fragmentary perspective view illustrating the connection of the hose end to the suction inlet of the canister housing;

FIG. 3 is a fragmentary enlarged vertical section illustrating the insertion of the hose end into the suction inlet;

FIG. 4 is a fragmentary vertical section showing the assembled relationship of the components;

FIG. 5 is a fragmentary enlarged section illustrating the guiding of the first electrical connector relative to the electrical connector in making the electrical connection therebetween;

FIG. 6 is an enlarged transverse section taken substantially along the line 6—6 of FIG. 3; and FIG. 7 is a perspective view of the canister with the cover open illustrating the mounting of the second electrical connector on the base in spaced relationship to the cover in the open position of the cover.

DESCRIPTION OF THE PREFERRED EMBODIMENT

In the illustrative embodiment of the invention as disclosed in the drawing, a vacuum cleaner structure generally designated 10 is shown to comprise a wheeled canister 11 having a body 12 and a cover 13. A suction hose generally designated 14 is removably connected to a filter bag 15 by means of a suction connector 16 at one end of the hose which may be extended through a suction inlet passage 17 formed in the cover 13 into engagement with a bag connector 18 associated with the filter bag 15.

As seen in FIG. 3, the suction inlet passage 17 comprises a tubular inlet defining a substantially cylindrical opening 19 for receiving a tubular end portion 20 of the suction connection 16. The end portion 20 may advantageously be swivelably connected to connection 16. As seen in FIG. 3, the hose end portion 20 is slidably received in the tubular suction inlet and, thus, only relatively small forces need be accommodated by the cover 13 in effecting the installation and removal of the hose end portion 20 relative to the suction inlet 17.

As indicated briefly above, however, the present invention is concerned with eliminating the problem of requiring a relatively strong cover construction to accommodate electrical circuitry and insulation and the substantial forces involved in effecting electrical connection between the hose and canister. Thus, as seen in FIG. 1, the hose 14 may be connected to a nozzle 21 provided with a brush motor 22. The brush motor is energized through conductors 23 extending from the motor through the hose and terminating at the suction connector 16 in a set of connectors in a first electrical connector 24 in the form of a plug.

Canister 11 is provided with a second electrical connector in the form of a receptacle 25 having a set of electrical terminals or connectors for electrical connection thereto of the first electrical connector as an incident of the suction connector 16 being installed in the suction inlet opening 19 when the cover is in the closed position of FIGS. 1 and 4. Second electrical connector 25 is connected through conductors 26 to a power supply cord 27, having a plug 28 for connection thereof to a conventional domestic power supply receptacle. As shown in FIG. 1, power is provided from the cord 27 to the suction fan motor 29 carried within the canister housing, generally designated 30.

As indicated above, the canister housing is defined by a lower body portion 12 and an overlying cover 13. The invention comprehends the mounting of the second electrical connector 25 to the body, or base, portion, and freely permitting the first electrical connector 24 to extend through the inlet passage 17 formed in the cover 13 to have electrical connected association with the second electrical connector 25, as an incident of the connection of the hose end to the canister.

More specifically, as seen in FIGS. 3, 4 and 6, the base portion of the canister housing is provided with an upstanding support 31 defining offset, opposed, spaced flanges 32. Second electrical connector or receptacle 25 is defined by a body portion 33 having a pair of outwardly opening channels 34 receiving the flanges 32 and securing the second electrical connector to the support.

As further shown in FIG. 3, the base 12 is further provided with a downwardly opening channel member 35 extending across the base to be abutted by the rear surface 36 of the body portion 33 of the second connector 25, to provide further support therefor on the base.

As seen in FIGS. 3 and 5, first electrical connector 24 includes projecting male terminals 37. Body 33 of the second electrical connector 25 defines a guide surface 38 comprising a frustoconical entrance surface leading to a tubular end connector 39 within body 33 and connected to the electrical conductor 26. As shown in FIG. 5, male terminal 37 is guided into the center of the end connector 39 by the frustoconical surface 38 in effecting the connection between first electrical connector 24 and second electrical connector 25. End connector 39 defines a passage which extends all of the way through receptacle 25 so that dirt can fall through instead of plugging up.

In the illustrated embodiment, first electrical connector 24 is formed integrally with the tubular end portion 20.

As further illustrated in FIG. 4, the upper end 40 of the second connector 25 projects angularly outwardly from the base 12. The angle is preselected so as to cause the upper end portion to extend generally perpendicularly to the confronting wall portion 41 of the cover 13 for facilitated alignment with the first electrical connector 24 carried by the tubular end 20 of the suction connector.

As seen in FIG. 7, the tubular suction inlet passage 17 defines a channel, or passage, for freely passing the first electrical connector 24 through the cover 13 when the suction connector 16 is inserted in the suction inlet opening 19. The passage opens to the suction inlet opening, as illustrated in FIG. 7. The bag connector is caused to be sealingly connected to the tubular end portion 20 when the suction connector is installed in the suction inlet opening 19 and the cover is in the closed position, as shown in FIGS. 1 and 4.

Thus, as discussed above, the hose end suction connector may be readily installed in the suction inlet opening of the canister housing cover 13 with minimum force transfer therebetween. The electrical connector 24 carried by the suction connector of the hose also freely passes through the suction inlet opening passage 17, thereby eliminating need for the cover to accommodate any forces from the insertion or removal of the first electrical connector relative thereto.

Rather, substantially all connection and disconnection forces involved in the connection and disconnection of the electrical connectors are accommodated by the body, or base, portion of the canister housing by virtue of the mounting of the second electrical connector 25 thereto. As shown in FIG. 7, the cover 13 defines a downwardly opening recess 43 which communicates with the upwardly opening suction space 44 defined by the canister base 12 and in which the filter bag 15 is removably disposed. Thus, as seen in FIG. 4, second electrical connector 25, and more specifically, the upper end 40 thereof, projects into the downwardly opening recess 43 in the connected arrangement of the apparatus.

As further shown in FIG. 7, cover 13 is removably hingedly mounted to the base 12 by suitable pivot hinges 45. The hinged mounting provides access to the filter bag, when desired. My co-pending application entitled "Invisible Hinge Means for Lid and Hood of a Canister Vacuum Cleaner", Serial No. 641,284, filed Aug. 16, 1984, now U.S. Pat. No. 4,555,700, issued Nov. 26, 1985, assigned to the assignee of the present invention, discloses one form of such a hinge in a canister vacuum cleaner having a cover or hood which is removably hingedly mounted to the canister body or base., and reference may be had to such application for details of such a hinge structure. In the form shown in FIG. 7, the cover 13 may include a hood portion having a plurality of upwardly opening recesses for receiving a plurality of correspondingly shaped attachment tools (not shown), which may be covered by a suitably hinged lid portion to provide the smooth upper surface of cover 13 shown in FIG. 1. The present invention eliminates the need for providing a flexible connector in the conductors 26 which would be necessary if the second electrical connector and associated electrical circuitry were mounted to the cover, thus providing a further minimizing of the cost of the vacuum cleaner structure.

The foregoing disclosure of specific embodiments is illustrative of the broad inventive concepts comprehended by the invention.

I claim:

1. In a vacuum cleaner having a canister including a base defining a suction space and a cover removably closing said space, a suction hose having an end defining a suction connector, means formed on said cover defining a suction inlet opening for receiving the hose end connector to conduct dirt laden air to said space, and electrical conductor means carried by the suction hose and having a first electrical connector associated with said suction connector, the improvement comprising:

a second electrical connector complementary to said first electrical connector mounted to said base to have electrical connected association with said first electrical connector as an incident of said suction connector being installed in said inlet opening, said cover being substantially free of forces developed in effecting electrical connection and disconnection of said first electrical connector relative to said second electrical connector.

2. The vacuum cleaner structure of claim 1 wherein said second electrical connector is disposed substantially at said inlet opening when the cover is closing said space.

3. The vacuum cleaner structure of claim 1 wherein said inlet opening defines a passage for passing said first electrical connector to and from electrical connection with said second electrical connector.

4. The vacuum cleaner structure of claim 1 wherein said cover is hingedly mounted to said base.

5. The vacuum cleaner structure of claim 1 wherein said cover is removably hinged to said base.

6. The vacuum cleaner structure of claim 1 wherein said means defining the inlet opening comprises tubular passage means slidably receiving said hose suction connector.

7. The vacuum cleaner structure of claim 1 further including means for guiding said first electrical connector into electrical connected association with said second electrical connector.

8. The vacuum cleaner structure of claim 1 further including means on said second electrical connector for guiding said first electrical connector into electrical connected association with said second electrical connector.

9. The vacuum cleaner structure of claim 1 wherein said first electrical connector is formed integrally with said suction connector.

10. The vacuum cleaner structure of claim 1 wherein said second electrical connector projects upwardly from said base.

11. The vacuum cleaner structure of claim 1 wherein said cover includes no electrical conductors.

12. In a vacuum cleaner having a canister including a base having a suction fan motor mounted therein and defining an upwardly opening suction space and a cover selectively overlying said space, a suction hose having an end defining a suction connector, means formed on said cover defining a suction inlet opening for receiving the hose end connector to conduct dirt laden air to said space, and a first electrical connector carried by the suction hose, the improvement comprising:

a second electrical connector complementary to said first electrical connector mounted to said base to have electrical connected association with said first electrical connector as an incident of said suction connector being connected to said inlet opening so that said cover is substantially free of forces developed in effecting electrical connection and disconnection of said first electrical connection relative to said second electrical connection.

13. The vacuum cleaner of claim 12 wherein said cover defines a recess and said second electrical connector extends upwardly into said recess when the cover is disposed to close said space.

14. The vacuum cleaner of claim 12 wherein said base defines upstanding support means and said second electrical connector is removably secured to said support means.

15. The vacuum cleaner of claim 12 wherein said base is provided with means for supporting the base on a flat surface with said second electrical connector extending upwardly angularly thereto.

16. The vacuum cleaner of claim 12 wherein said base defines upstanding support means and said second electrical connector is removably secured to said support means to extend substantially perpendicularly toward the cover.

17. The vacuum cleaner of claim 12 wherein said suction hose connector is freely slidably received in said suction inlet opening to a position where the associated first electrical connection is fully electrically connected to said second electrical connector.

18. The vacuum cleaner of claim 12 wherein said second electrical connector is resiliently yieldably secured to said base.

19. The vacuum cleaner of claim 12 wherein said cover is removably hingedly mounted to said base.

20. The vacuum cleaner of claim 12 wherein said cover includes no electrical carrying components yet said first electrical connector may be connected to said second electrical connector concurrently with the connection of said suction hose to said suction inlet opening.

* * * * *